US012471652B2

(12) United States Patent
Bastianelli

(10) Patent No.: US 12,471,652 B2
(45) Date of Patent: Nov. 18, 2025

(54) WATERPROOF GARMENT AND METHOD OF MANUFACTURE

(71) Applicant: Peter Bastianelli, Dunfermline (GB)

(72) Inventor: Peter Bastianelli, Dunfermline (GB)

( * ) Notice: Subject to any disclaimer, the term of this patent is extended or adjusted under 35 U.S.C. 154(b) by 575 days.

(21) Appl. No.: 17/436,680

(22) PCT Filed: Mar. 6, 2020

(86) PCT No.: PCT/GB2020/050543
§ 371 (c)(1),
(2) Date: Sep. 7, 2021

(87) PCT Pub. No.: WO2020/178601
PCT Pub. Date: Sep. 10, 2020

(65) Prior Publication Data

US 2022/0132977 A1 May 5, 2022

(30) Foreign Application Priority Data

Mar. 7, 2019 (GB) ..... 1903096

(51) Int. Cl.

| | |
|---|---|
| ***A43B 7/12*** | (2006.01) |
| ***A41D 31/10*** | (2019.01) |
| ***A43B 1/04*** | (2022.01) |
| ***A43B 23/02*** | (2006.01) |
| ***A43D 95/00*** | (2006.01) |

(52) U.S. Cl.
CPC ..... *A41D 31/10* (2019.02); *A43B 7/125* (2013.01); *A43B 23/022* (2013.01); *A43D 95/00* (2013.01)

(58) Field of Classification Search
None
See application file for complete search history.

(56) References Cited

U.S. PATENT DOCUMENTS

| | | | | |
|---|---|---|---|---|
| 4,188,689 | A | 2/1980 | Patrin | |
| 4,333,192 | A * | 6/1982 | Stockli | A43B 3/02 12/142 E |
| 4,707,874 | A | 11/1987 | Champagne | |
| 5,253,434 | A | 10/1993 | Curley, Jr. et al. | |

(Continued)

FOREIGN PATENT DOCUMENTS

| | | | |
|---|---|---|---|
| CN | 206586472 | U | 10/2017 |
| CN | 108135310 | A | 6/2018 |

(Continued)

OTHER PUBLICATIONS

Office action on CN202080033888.2, Nov. 3, 2023, CNIPA, Wuhan, Hubei, CN.

(Continued)

*Primary Examiner* — Jila M Mohandesi
(74) *Attorney, Agent, or Firm* — Kearney, McWilliams & Davis; Erik J. Osterrieder

(57) ABSTRACT

A waterproof garment, such as a shoe, is formed from a first seamless circular knitted liner, which is coated with resin and cured to form a waterproof layer. The first liner is fitted within a second seamless circular knitted liner. In the case of a shoe, a sole can be attached and a reliably waterproof shoe is thereby provided which can be efficiently manufactured. In another embodiment, the combined liners are used as a waterproof lining for a shoe upper.

26 Claims, 7 Drawing Sheets

(56) References Cited

U.S. PATENT DOCUMENTS

| | | | | |
|---|---|---|---|---|
| 6,446,360 | B1 * | 9/2002 | Sheets | A43B 23/07 12/142 T |
| 9,775,404 | B2 * | 10/2017 | Lyden | A43D 11/006 |
| 2004/0020077 | A1 | 2/2004 | Thomas et al. | |
| 2013/0000148 | A1 * | 1/2013 | Gellis | A41B 11/008 36/87 |
| 2013/0036527 | A1 | 2/2013 | Walsh | |
| 2015/0230563 | A1 * | 8/2015 | Bacino | A43B 23/022 36/43 |
| 2016/0031164 | A1 | 2/2016 | Downs et al. | |
| 2017/0311673 | A1 | 11/2017 | Urtaza Guerra | |
| 2018/0007999 | A1 * | 1/2018 | Chang | A43B 23/022 |
| 2018/0020770 | A1 * | 1/2018 | Chang | B29C 66/21 12/142 T |
| 2018/0156686 | A1 | 6/2018 | Cooper | |
| 2018/0352895 | A1 * | 12/2018 | Chang | A43B 23/04 |

FOREIGN PATENT DOCUMENTS

| | | | | |
|---|---|---|---|---|
| EP | 1 626 115 | A1 | 2/2006 | |
| EP | 1626115 | B1 * | 5/2014 | A41B 17/00 |
| EP | 3332661 | A1 * | 6/2018 | A43B 1/04 |
| EP | 3415023 | A1 * | 12/2018 | A43B 1/02 |
| GB | 1 240 496 | A | 7/1971 | |
| GB | 1 273 524 | A | 5/1972 | |
| GB | 2582003 | B | 9/2020 | |
| WO | 1997/020671 | A1 | 6/1997 | |
| WO | WO-9720671 | A1 * | 6/1997 | A43B 1/0027 |
| WO | 2017/173124 | A1 | 10/2017 | |

OTHER PUBLICATIONS

Chris Morris, UKIPO Patents Act 1977: Combined Search and Examination Report under Sections 17 and 18(3), Aug. 8, 2019, UKIPO, Newport, GB.

Ariza De Miguel, International Search Report & Written Opinion, Jul. 21, 2020, WIPO, Rijswijk, NL.

Alistair Hindles, Response to Combined Search and Examination Report under Sections 17 and 18(3), Dec. 31, 2019, Hindles Ltd., Edinburgh, GB.

David Holdsworth, Notification of Grant: Patent Serial No. GB2582003, Apr. 27, 2021, UKIPO, Newport, GB.

* cited by examiner

WATERPROOF GARMENT AND METHOD OF MANUFACTURE

CROSS-REFERENCE TO RELATED APPLICATIONS

This is a 371 application of and claims priority to PCT/GB2020/050543 filed on Mar. 6, 2020 that claims priority to GB provisional application number 1903096.4 filed on Mar. 7, 2019, wherein each of the foregoing applications is incorporated by this reference in its entirety.

FIELD

The invention relates to a waterproof garment, typically a shoe, and a method of constructing a waterproof garment.

BACKGROUND

The invention will now be described with reference to a waterproof shoe. However, the invention is also applicable to other waterproof garments (such as gloves, hats, jackets and trousers).

At the present time, waterproof shoes are typically made from a waterproof laminate cut into various pieces and sewn together to create a bootie. In this way, the bootie forms a liner for a shoe. The shoe is completed by fitting the bootie lining into an upper of a shoe or boot and then passing the lined upper through a series of different production steps (e.g. lasting the upper, fitting a sole) to finish off the shoe. However, the integrity of the waterproofness of the bootie is weakened by the introduction of stitched seams into the waterproof fabric to join the various pieces of laminate together. Therefore, the seams are covered with a waterproof tape (e.g. a seam sealing tape) so that the liner and thereby the shoe is waterproof despite the seams. The waterproof tape is typically a heat activated tape of a suitable width (e.g. 20 mm or 22 mm).

Before the bootie is stitched into the upper of the shoe or boot, the bootie is tested for faults. The waterproof integrity of the bootie can be affected by various missteps during the bootie manufacturing process. These include poorly setup machines, mistakes when taping the seams, and mishandling the bootie. Faults in the bootie typically occur at the seams. Faults can be corrected by identifying the fault during a testing step and applying additional tape over the faulty seams where required. However, the process of repairing and retesting a failed bootie is expensive. Repairing a failed bootie requires the fault to be covered by more of the waterproof tape. The waterproof tape is expensive and therefore the use of additional tape increases the cost to manufacture a waterproof bootie.

The invention seeks to provide improved ways to make a waterproof garment, which are cost effective and reliable.

SUMMARY

According to first aspect of the invention there is provided a method of constructing a waterproof garment, the method comprising providing a first liner and a second liner. The first and second liners are each typically a continuous body of fabric shaped to enclose a body part of a wearer (e.g. a wearer's foot). In some embodiments, the first and second liners together form an internal lining of the finished garment. In some embodiments, the outermost of the first and second liners forms at least a part of the exterior covering of the finished garment.

The first liner typically comprises an inner surface and an outer surface and an opening. The first liner is typically in the form of a closed tube. By a closed tube we refer to a tube which is closed at one end and has an opening at the other end. The first liner is configured to receive a body part of a wearer (e.g. foot, in the case of a shoe) through the opening. In use, the first liner surrounds the body part of a wearer (e.g. foot, in the case of a shoe). The inner surface may be the surface of the first liner being closest to the wearer's body part. The first liner may be in the shape of a bootie. The first liner may further comprise a heel portion. The first liner may further comprise a toe portion.

Typically, the first liner is seamless. Typically, the first liner is formed of a continuous body of material without seams. Typically, the first liner is formed by circular knitting. The first liner is typically a circular knitted liner. The first liner is typically a seamless closed tube, for example a seamless closed tube formed by circular knitting.

It may be that the first liner is formed of a material which is water permeable. The first liner may be formed of a material which is not waterproof, that is, liquid water may pass through, i.e. between the inner and outer surfaces of the first liner.

The method comprises coating the first liner with a resin. The resin being a substance which is curable to form a waterproof layer. The resin is then cured. Thus, the first liner is rendered waterproof by the cured resin layer. Typically, the first liner is formed of a material which is not inherently waterproof and is coated with a waterproof cured resin layer. The resin may be viscous. Typically, the resin comprises polymerizable material (e.g. monomers), for example polyurethane.

The first liner may be coated with the resin, which is cured, and thereby rendered waterproof, across at least 50%, at least 75%, at least 90% or all of its surface area. Where the first liner is a closed tube, for example a circular knitted closed tube, the first liner may be coated, and thereby rendered waterproof, across the whole of the closed tube, or the whole of the closed tube except for a sleeve portion extending around and defining the opening (also known as a throat in the case of shoes). The first liner may be in the form of a closed tube which is waterproof continuously from the closed end to within one centimetre of the open end. One skilled in the art will appreciate that the sleeve portion immediately adjacent the opening of a waterproof garment (e.g. a shoe or glove), or above the base of a wearer's ankle need not itself be waterproof. The first liner may comprise a closed tube having a sleeve portion and a body/core portion which encloses a body part of a wearer, e.g. a foot or a hand, when in use. It may be that the body/core portion is entirely coated with the resin (and so is coated with the layer of cured resin after curing, and is thereby waterproof). It may be that the sleeve portion is not entirely coated with resin (and so is not entirely coated with the layer of cured resin after curing, and is thereby not completely waterproof). In the case of a shoe, the body/core portion may be a foot portion.

It may be that the first liner is coated with resin, which is then cured, thereby waterproofing the first liner at least where it extends around a wearer's foot in use, e.g. up to at least the ankle when the garment is a shoe.

The method typically comprises covering the resin with a second liner. The method typically comprises fitting a second liner to and/or around the first liner, typically after the resin has been cured. The first liner may thereby be nested within the second liner. The second liner may be attached, e.g. adhered, to the first liner. Typically, the layer of cured resin is covered by the second liner after the resin has cured. The second liner may be adhered to and thereby cover the layer of cured resin. It may be that the second liner protects the layer of cured resin from abrasion. It may be that the second liner prevents debris (such as grit, stones or dust) from contacting the layer of cured resin. That is, the cured resin forms a layer on a surface of the first liner and the second liner covers the layer of cured resin, thereby reducing damage to the cured resin by abrasion or debris.

It may be that the first and second liners form (may function as) an internal waterproof lining of the finished garment; that is, the first and second liners are towards a body part of the wearer and the finished garment comprises an external covering which covers the first and second liners. Typically the innermost of the first and second liners forms the innermost surface of the finished garment.

It may be that the first and second liners form at least a part of an exterior covering of the finished garment; that is, the first and second liners are toward a body part of the wearer and at least 50% of the exterior surface area of the finished garment is formed of the first and second liners. The finished garment may further comprise an additional external covering which covers the first and second liners, such that the first and second liners form at least 50% of the exterior surface area of the finished garment.

Typically, the second liner has an inner surface, an outer surface and an opening. The second liner may be in the shape of a bootie. The second liner may comprise a heel portion. The second liner may comprise a toe portion. Typically, the second liner is seamless.

Typically, the second liner is formed of a continuous body of material without seams. The second liner may be formed of a textile material such as a woven or non-woven textile. However, typically, the second liner is formed by circular knitting. The second liner is typically a circular knitted liner. The second liner is typically a seamless closed tube, for example a seamless closed tube formed by circular knitting. The first and/or second liners may be formed from woven textiles which comprise stretch fibres or elastic fibres.

The first liner and/or second liner may be made from polyester. It may be that the first liner and/or second liner are made from a polyester blend, e.g. polyester blended with stretch or elastic fibres. It may be that the first liner and/or second liner are made from wool or a wool blend. It may be that the first liner and/or second liner are made by circular knitting and the material used is any material suitable for circular knitting. It may be that the weight and/or thickness of the material for the first liner and second liner are the same. It may be that the weight and/or thickness of the material for the first liner and second liner are different.

It may be that the second liner is formed of a material which is water permeable. The second liner may be formed of a material which is not waterproof, that is, liquid water may pass through, i.e. between the inner and outer surfaces of the second liner. Typically, the second liner has no waterproof coating thereon. It may be that the method comprises coating the second liner with an anti-mould preparation. It may be that the method comprises coating the second liner with a water-repellent treatment, e.g. a high-quality durable water repellent (DWR).

Typically, the first and second liners are fitted together such that the layer of cured resin is located between the first and second liners. The first and second liners may be joined, e.g. attached, together. It may be that an adhesive is applied between the first and second liners (e.g. between a surface of the second liner and the cured resin layer of the first liner). It may be that the first and second liners are adhered together by welding or application of an adhesive, e.g. a glue or the like. It may be that the adhesive is applied to the surface of the first liner facing the second liner (e.g. outer surface) before covering the resin layer with the second liner. It may be that the first liner is fitted into the second liner. It may be that the first liner is fitted onto the second liner. It may be that the second liner covers the resin layer without being adhered to the first liner.

It may be that the first and second liners are stitched together, e.g. around the opening, for example the second liner may be joined to the sleeve region of the first liner, for example by stitching or welding. It may be that attaching the first and second liners forms a topline around the top of the opening. It may be that a webbing or textile tape is applied where the first and second liners are attached to give a (e.g. neat) finished look.

It may be that the resin is applied by an automated system or by an operator. It may be that coating the first liner is by brushing the resin on the first liner. It may be that coating the first liner is by painting the resin on the first liner. It may be that coating the first liner is by spraying the resin on the first liner. It may be that coating the first liner is by dipping the first liner into the resin.

It may be that the first liner is coated with one or more layers of one or more resins. The first liner may be coated with a plurality of layers, of the same or different resins. It may be that the one or more coating steps comprise at least one of brushing, painting, spraying, and/or dipping. It may be that coating the first liner with a resin comprises coating the outer surface of the first liner.

The method comprises curing the resin to thereby waterproof the first liner. That is, the process of applying a resin to the first liner and curing the resin causes the resulting coated first liner to be waterproof. Typically, the cured resin forms a layer on the first liner, e.g. on the outer surface of the first liner.

The first liner and/or second liner may be made in discrete sizes with stretch or elastic fibres allowing the resulting garment to fit comfortably onto the wearer. For example, the first liner may be for shoes and the dimension of the liner may be selected from a group of dimensions for discrete foot sizes.

It may be that the second liner comprises a collar which is fitted over the first and second liners around at least some of the periphery of the opening.

It may be that the first liner is an inside liner and the inner surface of the first liner receives a body part of a wearer via the at least one opening. For example, the liner may be an inside liner of a shoe in which a user puts their foot. It may be that the liners are manufactured in an inside out configuration, that is, the first and second liners are reversed in order during the manufacturing process. It may be that the liners are then inverted to a final configuration. In this case, the second liner receives a body part of a wearer via the at least one opening, for example the foot, in the case of a shoe.

Typically the first and second liners, with the layer of cured resin therebetween, is formed into a garment, for example a shoe, giving a waterproof garment. Typically, the garment has an opening and a waterproof body portion which encompasses a wearer's body part (e.g. foot) introduced through the opening in use.

More generally, the waterproof garment may be footwear or headgear or a glove. That is, the waterproof garment may be, for example, a shoe or boot, a hat or a glove, a jacket or a pair of trousers.

For example, it may be that the waterproof garment is a jacket. The first and second liners and the cured resin therebetween may form at least part of a body portion of the jacket. It may be that the body portion of the jacket is formed by a continuous piece of fabric, that is the jacket does not have a zip. It may be that the waterproof garment is a pair of trousers. The first and second liners and the cured resin therebetween may form at least a part of the legs of the trousers. It may be that the waterproof garment is a glove, wherein the first and second liners are shaped to fit around a wearer's hand and fingers. It may be that the waterproof garment is a hat, wherein the first and second liners are shaped to fit a wearer's head (i.e. fit onto the wearer's head).

It may be that the resin is a thermosetting resin. In other words, the resin is cured when subjected to heat, i.e. a heat-curable resin. That is, the resin becomes hardened when subjected to heat thereby forming a hardened layer on the first liner. It may be that the resin is a photo-curable resin, i.e. a photopolymerisation resin. In other words, the resin is cured when subjected to light, i.e. the resin is cured by light or photo-initiated. That is, the resin becomes hardened when subjected to light thereby forming a hardened layer on the first liner.

It may be that the resin is a polymeric agent (e.g. agents which comprise monomers and/or copolymers), or an epoxy resin. It may be that the resin is polyurethane, preferably liquid polyurethane (e.g. a solvent-based liquid polyurethane or a water-based liquid polyurethane) which provides a resin with a lower viscosity allowing the resin to be applied by methods which would otherwise be impractical for a high viscosity resin, such as spraying. It may be that the resin is thermoplastic polyurethane. It may be that the resin is a polyester resin. It may be that the resin is an acrylic resin. It may be that the resin is a fluoroplastic resin, e.g. a polytetrafluoroethylene (PTFE) based resin.

It may be that the resin, when cured, allows moisture to pass through the first liner in one direction only, e.g. from the inner surface to the outer surface of the first liner. It may be that moisture passes through the first liner in response to a temperature differential. That is, the moisture passes from a hot side of the first liner to a cooler side, e.g. from the side of the first liner with a wearer's body part to an outer side of the liner.

It may be that curing the resin comprises heating the coated first liner. It may be that heating the coated first liner comprises placing the coated first liner near a heat source, such as into an oven. It may be that heating the coated first liner comprises using a heat gun, or the like. That is, the curing process may be localised to the areas which are coated with the resin rather than subjecting the whole first liner to the heat. It may be that the oven is heated before the coated first liner is placed inside, i.e. the oven is pre-heated. It may be that the coated first liner is placed into the oven for a predetermined length of time at a predetermined temperature.

It may be that curing the resin comprises subjecting the coated first liner to light, e.g. by shining light onto the coated first liner. That is, the resin is photo-cured. It may be that the wavelength of the light to cure the resin is in the UV range of the electromagnetic spectrum, e.g. from a UV light source. It may be that the light is applied to the coated areas of the first liner. That is, the curing process may be localised.

It may be that coating the first liner with a resin comprises coating the outer surface of the first liner but the inner surface of the first liner is not coated with resin.

It may be that the first liner is fitted onto a mechanical form prior to coating with the resin to maintain the shape of the liner. For example, it may be the first liner is for a shoe or boot (e.g. a hiking boot) and the mechanical form is a last or the like.

It may be that the method comprises one or more steps of removing excess resin from the first liner prior to curing the coated first liner. That is, an excess amount of resin may be used to coat the first liner thereby coating all the required surface. It may be that removing the excess resin is by brushing the coated first liner. Alternatively, or in addition, it may be that removing the excess resin is by absorbing the excess resin with a fabric, e.g. a sponge or the like. Alternatively, or in addition, it may be that removing the excess resin is by vibrating the coated first liner. Alternatively, or in addition, it may be that removing the excess resin is by shaking the coated first liner. Alternatively, or in addition, it may be that removing the excess resin is by spinning the coated first liner. Alternatively, or in addition, it may be that removing the excess resin is by blowing air over the coated first liner, e.g. be placing the coated first liner into the path of an air flow. It may be that the air is cold air, such that the air flow causes or encourages the excess resin to drip off the first liner. Alternatively, it may be that the air is heated. Alternatively, or in addition, it may be that removing the excess resin is by positioning and leaving the coated first liner such that the excess resin may drip off the coated first liner. It may be that the coated first liner is left for a predetermined length of time dependent on the viscosity of the resin.

It may be that the method comprises coating the coated first liner (i.e. the first liner with a layer of cured resin) with one or more subsequent layers of resin. That is, the first liner is re-coated. It may be that the resin for the one or more subsequent layers of resin is the resin used for the first coating of the first liner or a further resin. That is, the one or more subsequent layers of resin is formed using one or more resins different from the resin used for the first layer of cured resin. For example, the resin used for the first layer of cured resin may be a heat-curable resin and the one or more resins used for the one or more subsequent layers of resin may be a light-curable resin. It may be that the resin for the one or more subsequent layers of resin has a different viscosity such that the thickness of the one or more subsequent layers is different from the thickness of the first layer of resin. The one or more subsequent layers of resin are then cured according to the resin or further resin used to form a plurality of layers of cured resin on the first liner.

It may be that the resin or the further resin of the one or more subsequent layers of resin is a thermosetting resin. It may be that the resin or the further resin of the one or more subsequent layers of resin is a photo-sensitive resin, i.e. a photopolymerisation resin. It may be that the resin or the further resin of the one or more subsequent layers of resin is a polymeric agent or an epoxy. It may be that the resin or the further resin of the one or more subsequent layers of resin is polyurethane, typically liquid polyurethane (e.g. a solvent-based liquid polyurethane or a water-based liquid polyurethane). It may be that the resin or the further resin of the one or more subsequent layers of resin is thermoplastic polyurethane. It may be that the resin or the further resin of the one or more subsequent layers of resin is a polyester resin. It may be that the resin or the further resin of the one or more subsequent layers of resin is an acrylic resin. It may be that the resin or the further resin of the one or more subsequent layers of resin is a fluoroplastic resin, e.g. a polytetrafluoroethylene (PTFE) based resin.

It may be that the resin or the further resin of the one or more subsequent layers of resin, when cured, allows moisture to pass between the inner and outer surfaces of the first liner. It may be that the resin or the further resin of the one or more subsequent layers of resin allows moisture to pass between the surfaces of the first liner in response to a temperature differential.

It may be that curing the one or more subsequent layers of resin comprises heating the re-coated first liner, e.g. by placing the re-coated first liner into an oven. It may be that heating the coated first liner comprises using a heat gun, or the like. That is, the curing process may be localised to the areas which are coated with the resin rather than subjecting the whole first liner to the heat. It may be that the oven is heated before the re-coated first liner is placed inside, i.e. the oven is pre-heated. It may be that the re-coated first liner is placed inside the oven for a predetermined length of time at a predetermined temperature.

Alternatively, it may be that curing the one or more subsequent layers of resin on the first liner comprises subjecting the re-coated first liner to light, e.g. by shining UV light, for example, from a UV light source.

It may be that the method comprises testing the coated first liner after the resin has cured to determine the waterproofness of the first liner. It may be that the testing is performed before one or more subsequent coatings of resin is applied. It may be that the testing is performed after one or more subsequent coatings of resin is applied. It may be that testing the coated first liner comprises filling the first liner with air and submerging or dunking the first liner into a tank of water. It may be that testing the coated first liner comprises filing the first liner with water and forcing air into the first liner. It may be that testing the coated first liner comprises determining defects or faults of the coating on the first liner.

It may be that the method comprises the step of coating determined defects or faults of the coating on the first liner with the resin and curing the coated defects or faults. That is, the first liner, or one or more sections of the first liner, is re-coated to seal points of defects or faults. Alternatively, it may be that the method comprises the step of coating determined defects or faults of the coating on the first liner with a further resin and curing the coated defects or faults. That is, a different resin may be used to coat determined defects in the coating on the first liner, i.e. to seal points of defects or faults. For example, a further resin may be used to coat, i.e. patch, the determined defects, the further resin being one which can be locally cured (i.e. the curing process can be applied to specific areas on the first liner). The different resin may be one of a thermosetting resin, a photo-sensitive resin, polyurethane or a derivative thereof, for example a polyurethane glue, a polyester resin, an acrylic resin, or a fluoroplastic resin, for example a PTFE based resin.

It may be that the re-coated first liner is tested to check that the liner is waterproof. It may be that testing the re-coated first liner comprises filling the first liner with air and submerging or dunking the first liner into a tank of water. It may be that testing the re-coated first liner comprises determining defects or faults of the coating on the first liner. It may be that testing the re-coated first liner comprises filling the first liner with water and forcing air into the first liner.

It may be that the method comprises fitting an external covering on the first and second liners. It may be that the external covering completely covers the first and second liners; that is the first and second liners are towards a body part of the wearer and that the first and second liners form (may function as) a waterproof lining for the finished garment. Alternatively, it may be that the first and second liners form at least 50% of the exterior surface area of the finished garment. That is, the exterior surface area of the finished garment comprises the external covering and the first and second liners. Where the garment is a shoe, it may be that the outermost of the first and second liners forms at least 50% of the external upper surface of the shoe. Typically the innermost of the first and second liners defines the body-receiving interior of the garment. Typically the second liner is outermost and the first liner is innermost, unless the first and second liners have been turned inside out during manufacture in which case it is the other way round.

It may be that the outermost of the first and second liners comprises an additive to alter the appearance of the finished garment when subjected to light of particular wavelengths. For example, the additive may be an optical brightener (or brightening) agent which gives the finished garment the appearance of being whiter when subjected to light in the UV range of the spectrum (e.g. light from a black light or another UV light source).

It may be that the garment is a shoe, and that the method comprises fitting the first and second liners into an upper (e.g. where the upper is an external covering). The (combined) first and second liners may thereby form a waterproof lining for the shoe. It may be that the upper is a knitted upper, leather, synthetic leather, textile or any combination thereof. It may be that the upper is a Strobel shoe or boot.

Alternatively, it may be that the first and second liners form the upper of the shoe.

It may be that the method comprises the step of applying an anti-mould treatment to the upper. It may be that the method comprises the step of applying a water-repellent treatment, e.g. a high-quality durable water repellent (DWR), to the upper.

The invention extends in a second aspect to a waterproof garment, comprising a first liner and a second liner, with the first liner fitted within the second liner or vice versa, the first liner having a waterproof layer formed on the surface of the first liner facing the second liner. (When the first liner is within the second liner, the waterproof layer is on the outer surface of the first liner. When the second liner is within the first liner, the waterproof layer is on the inner surface of the first liner). Typically, the waterproof layer is a cured resin layer. The first and second liners are each typically a continuous body of fabric shaped to enclose a body part of a wearer (e.g. a wearer's foot). Typically, the innermost of the first and second liners forms the internal lining of the garment (i.e. the first and second liners are completely covered by an external covering). In some embodiments, the outermost of the first and second liners form at least part of an exterior covering of the garment. The first and second liners may form (may function as) a waterproof lining for the garment (e.g. a shoe).

The waterproof garment may be footwear or headgear or a glove. That is, the waterproof garment may be, for example, a shoe or boot, a hat or a glove, a jacket or a pair of trousers.

For example, it may be that the waterproof garment is a jacket. The first and second liners and the cured resin therebetween may form at least part of a body portion of the jacket. It may be that the body portion of the jacket is formed by a continuous piece of fabric, that is the jacket does not have a zip. It may be that the waterproof garment is a pair of trousers. The first and second liners and the cured resin therebetween may form at least a part of the legs of the trousers. It may be that the waterproof garment is a glove, wherein the first and second liners are shaped to fit around a wearer's hand and fingers. It may be that the waterproof garment is a hat, wherein the first and second liners are shaped to fit a wearer's head (i.e. fit onto the wearer's head).

The first liner is typically in the form of a closed tube. The first liner is configured to receive a body part of a wearer (e.g. foot, in the case of a shoe) through the opening. The first liner may be in the shape of a bootie.

Typically, the first liner is seamless. Typically, the first liner is formed of a continuous body of material without seams. Typically, the first liner is a circular knitted liner. The first liner is typically a seamless closed tube, for example a seamless circular knitted closed tube.

It may be that the first liner is formed of a material (e.g. textile) which is water permeable, with the waterproof coating thereon. Liquid water could therefore soak into the textile but will be blocked by the waterproof coating.

The cured resin layer may comprise a polymer such as polyurethane or PTFE.

The waterproof layer may extend across at least 50%, at least 75%, at least 90% or all of the surface area of the first liner.

Where the first liner is a closed tube, for example a circular knitted closed tube, the waterproof layer may extend across the whole of the closed tube, or the whole of the closed tube except for a sleeve portion extending around and defining the opening.

The first liner may comprise a closed tube having a sleeve portion and a body portion which encloses a body part of a wearer, e.g. a foot, when in use. It may be that the body portion is entirely coated with the waterproof layer. It may be that the sleeve portion (also known as a throat in the case of shoes) is not entirely coated with the waterproof layer.

Typically, the first liner is nested within the second liner or vice versa. The second liner may be attached, e.g. adhered to the first liner. The second liner may be adhered to and thereby cover the layer of cured resin. It may be that the second liner protects the layer of cured resin from abrasion. It may be that the second liner prevents debris (such as grit, stones or dust) from contacting the layer of cured resin. That is, the cured resin forms a layer on a surface of the first liner and the second liner covers the layer of cured resin, thereby reducing damage to the cured resin by abrasion or debris.

It may be that the first and second liners form (may function as) an internal waterproof lining of the garment; that is, the first and second liners are towards a body part of the wearer and the finished garment comprises an external covering which covers the first and second liners (e.g. the external covering completely covers the first and second liners).

It may be that the first and second liners form at least a part of an exterior covering of the garment; that is, the first and second liners are toward a body part of the wearer and at least 50% of the exterior surface area of the garment is formed of the first and second liners. The garment may further comprise an additional external covering which covers the first and second liners, such that the first and second liners form at least 50% of the exterior surface area of the garment.

It may be that the outermost of the first and second liners comprises an additive to alter the appearance of the finished garment when subjected to light of particular wavelengths. For example, the additive may be an optical brightener (or brightening) agent which gives the finished garment the appearance of being whiter when subjected to light in the UV range of the spectrum (e.g. light from a black light or another UV light source).

Typically, the second liner has an inner surface, an outer surface and an opening. The second liner may be in the shape of a bootie. The second liner may comprise a heel portion. The second liner may comprise a toe portion. Typically, the second liner is seamless. Typically, the second liner is formed of a continuous body of material without seams. The second liner may be formed of a textile material such as a woven or non-woven textile. However, typically, the second liner is formed by circular knitting. The second liner is typically a circular knitted liner. The second liner is typically a seamless closed tube, for example a seamless closed tube formed by circular knitting. The first and/or second liners may be formed from woven textiles which comprise stretch fibres or elastic fibres.

The first liner and/or second liner may be made from polyester. It may be that the first liner and/or second liner are made from a polyester blend, e.g. polyester blended with stretch or elastic fibres. It may be that the first liner and/or second liner are made from wool or a wool blend. It may be that the first liner and/or second liner are made by circular knitting and the material used is any material suitable for circular knitting. It may be that the weight and/or thickness of the material for the first liner and second liner are the same. It may be that the weight and/or thickness of the material for the first liner and second liner are different.

It may be that the second liner is formed of a material which is water permeable. The second liner may be formed of a material which is not waterproof, that is, liquid water may pass through, i.e. between the inner and outer surfaces of the second liner. Typically, the second liner has no waterproof coating thereon. It may be that the second liner is coated with an anti-mould preparation. It may be that the second liner is coated with a water-repellent treatment, e.g. a high-quality durable water repellent (DWR).

Typically, the first and second liners are fitted together such that the layer of cured resin is located between the first and second liners. The first and second liners may be joined, e.g. attached, together. It may be there is adhesive between the first and second liners (e.g. between a surface of the second liner and the cured resin layer of the first liner). It may be that the first and second liners are adhered together by welds or adhesive. However, it may be that the first liner fits within the second liner or vice versa without being adhered to the second liner.

It may be that the first liner has the cured resin layer thereon, forming a waterproof layer for the first liner, at least where it extends around a wearer's foot in use, up to at least the ankle.

It may be that the first and second liners are joined with stitches, e.g. around the opening, for example the second liner may be joined to the sleeve region of the first liner, for example by stitching or welding. It may be that where the first and second liners are joined forms a topline around the top of the opening. It may be that a webbing or textile tape is applied where the first and second liners are attached to give a (e.g. neat) finished look.

It may be that the first liner is coated with one or more layers of one or more resins. The first liner may be coated with a plurality of layers, of the same or different resins.

The first liner and/or second liner may be made in discrete sizes with stretch or elastic fibres allowing the resulting garment to fit comfortably onto the wearer. For example, the first liner may be for shoes and the dimension of the liner may be selected from a group of dimensions for discrete foot sizes.

It may be that the second liner comprises a collar which is fitted over the first and second liners around at least some of the periphery of the opening.

It may be that the first liner is an inside liner and the inner surface of the first liner receives a body part of a wearer via the at least one opening. For example, the liner may be an inside liner of a shoe in which a user puts their foot. However, where the second liner is within the first liner, the second liner receives a body part of a wearer via the at least one opening, for example the foot, in the case of a shoe.

The third and fourth aspects of the invention relate to a method of making a waterproof garment, and a waterproof garment, in which instead of using a seamless first liner, the first liner is formed using seamed fabric.

In a third aspect of the invention there is provided a method of constructing a waterproof garment comprising providing a first liner and a second liner. The first and second liners are typically a continuous body of fabric shaped to enclose a body part of a wearer (e.g. a wearer's foot). In some embodiments, the first and second liners form the internal lining of the finished garment. In some embodiments, the first and second liners form at least a part of an exterior covering of the finished garment.

The first liner typically comprises an inner surface and an outer surface and an opening. The first liner is typically in the form of a closed tube. The first liner is configured to receive a body part of a wearer (e.g. foot, in the case of a shoe) through the opening. In use, the first liner surrounds the body part of a wearer (e.g. foot, in the case of a shoe). The inner surface may be the surface of the first liner being closest to the wearer's body part. The first liner may be in the shape of a bootie. The first liner may comprise a heel portion. The first liner may comprise a toe portion.

In the third aspect, the first liner comprises at least two pieces of fabric sewn together, thereby forming one or more seams in the first liner. Typically, the method comprises stitching the one or more seams in the first liner.

The method comprises coating the first liner with a resin. The resin being a substance which is curable to form a waterproof layer. The resin is then cured. Thus, the first liner is rendered waterproof by the cured resin layer. Typically, the first liner is formed of a material which is not inherently waterproof and is coated with a waterproof cured resin layer. The resin may be viscous. Typically, the resin comprises polymerizable material (e.g. monomers), for example polyurethane.

The first liner may be coated with the resin, which is cured, and thereby rendered waterproof, across at least 50%, at least 75%, at least 90% or all of its surface area. Where the first liner is a closed tube, the first liner may be coated, and thereby rendered waterproof, across the whole of the closed tube, or the whole of the closed tube except for a sleeve portion (also known as a throat in the case of shoes) extending around and defining the opening. The first liner is typically in the form of a closed tube which is waterproof continuously from the closed end to within one centimetre of the open end. One skilled in the art will appreciate that the sleeve portion immediately adjacent the opening of a waterproof garment (e.g. a shoe or glove) need not itself be waterproof. The first liner may comprise a closed tube having a sleeve portion and a body/core portion which encloses a body part of a wearer, e.g. a foot or a hand, when in use. It may be that the body/core portion is entirely coated with the resin (and so is coated with the layer of cured resin after curing, and is thereby waterproof). It may be that the sleeve portion is not entirely coated with resin (and so is not entirely coated with the layer of cured resin after curing, and is thereby not completely waterproof).

It may be that the first liner is coated with resin, which is then cured, thereby waterproofing the first liner at least where it extends around a wearer's foot in use, up to at least the ankle when the garment is a shoe.

The method typically comprises covering the resin with a second liner. The method typically comprises fitting a second liner to and/or around the first liner, typically after the resin has been cured. The first liner may thereby be nested within the second liner. The second liner may be attached, e.g. adhered, to the first liner. Typically, the layer of cured resin is covered by the second liner after the resin has cured. The second liner may be adhered to and thereby cover the layer of cured resin. It may be that the second liner protects the layer of cured resin from abrasion. It may be that the second liner prevents debris (such as grit, stones or dust) from contacting the layer of cured resin. That is, the cured resin forms a layer on a surface of the first liner and the second liner covers the layer of cured resin, thereby reducing damage to the cured resin by abrasion or debris.

It may be that the first and second liners form (may function as) an internal waterproof lining of the finished garment; that is, the first and second liners are towards a body part of the wearer and the finished garment comprises an external covering which covers the first and second liners. Typically the innermost of the first and second liners form the innermost surface of the garment.

It may be that the first and second liners form at least a part of an exterior covering of the finished garment; that is, the first and second liners are toward a body part of the wearer and at least 50% of the exterior surface area of the finished garment is formed of the first and second liners. The finished garment may further comprise an additional external covering which covers the first and second liners, such that the first and second liners form at least 50% of the exterior surface area of the finished garment.

Typically, the second liner has an inner surface, an outer surface and an opening. The second liner may be in the shape of a bootie. The second liner may comprise a heel portion. The second liner may comprise a toe portion. Typically, the second liner is seamless. Typically, the second liner is formed of a continuous body of material without seams. The second liner may be formed of a textile material such as a woven or non-woven textile. However, typically, the second liner is formed by circular knitting. The second liner is typically a circular knitted liner. The second liner is typically a seamless closed tube, for example a seamless closed tube formed by circular knitting. The first and/or second liners may be formed from woven textiles which comprise stretch fibres or elastic fibres.

The first liner and/or second liner may be made from polyester. It may be that the first liner and/or second liner are made from a polyester blend, e.g. polyester blended with stretch or elastic fibres. It may be that the first liner and/or second liner are made from wool or a wool blend. It may be that the second liner is made by circular knitting and the material used is any material suitable for circular knitting. It may be that the weight and/or thickness of the material for the first liner and second liner are the same. It may be that the weight and/or thickness of the material for the first liner and second liner are different. It may be that the first liner and/or second liner are formed of a textile material such as a woven textile or a knitted textile. The first liner may be made from a laminate (e.g. comprising at least two layers of material). It may be that the laminate comprises a textile layer and a foam layer. The first liner may be made from a waterproof laminate fabric comprising two or more layers. It may be that the waterproof laminate fabric comprises three layers. It may be that the three layers of the waterproof laminate fabric is a face layer, a membrane (e.g. a polytetrafluoroethylene-based membrane such as eVENT® Fabric) and a bonding layer (e.g. a nylon-based layer such as a tricot layer).

It may be that the second liner is formed of a material which is water permeable. The second liner may be formed of a material which is not waterproof, that is, liquid water may pass through, i.e. between the inner and outer surfaces of the second liner. Typically, the second liner has no waterproof coating thereon. It may be that the method comprises coating the second liner with an anti-mould preparation. It may be that the method comprises coating the second liner with a water-repellent treatment, e.g. a high-quality durable water repellent (DWR).

Typically, the first and second liners are fitted together such that the layer of cured resin is located between the first and second liners. The first and second liners may be joined, e.g. attached, together. It may be that an adhesive is applied between the first and second liners (e.g. between a surface of the second liner and the cured resin layer of the first liner). It may be that the first and second liners are adhered together by welding or application of an adhesive, e.g. a glue or the like. It may be that the adhesive is applied to the surface of the first liner facing the second liner (e.g. outer surface) before covering the resin layer with the second liner. It may be that the first liner is fitted into the second liner. It may be that the first liner is fitted onto the second liner. It may be that the second liner covers the resin layer without being adhered to the first liner.

It may be that the first and second liners are stitched together, e.g. around the opening, for example the second liner may be joined to the sleeve region of the first liner, for example by stitching or welding. It may be that attaching the first and second liners forms a topline around the top of the opening. It may be that a webbing or textile tape is applied where the first and second liners are attached to give a (e.g. neat) finished look.

It may be that the resin is applied by an automated system or by an operator. It may be that coating the first liner is by brushing the resin on the first liner. It may be that coating the first liner is by painting the resin on the first liner.

It may be that the first liner is coated with one or more layers of one or more resins. The first liner may be coated with a plurality of layers, of the same or different resins. It may be that the one or more coating steps comprise at least one of brushing and/or painting. It may be that coating the first liner with a resin comprises coating the outer surface of the first liner.

The method comprises curing the resin to thereby waterproof the first liner. That is, the process of applying a resin to the first liner and curing the resin causes the resulting coated first liner to be waterproof. Typically, the cured resin forms a layer on the first liner, e.g. on the outer surface of the first liner.

The first liner and/or second liner may be made in discrete sizes with stretch or elastic fibres allowing the resulting garment to fit comfortably onto the wearer. For example, the first liner may be for shoes and the dimension of the liner may be selected from a group of dimensions for discrete foot sizes.

It may be that the second liner comprises a collar which is fitted over the first and second liners around at least some of the periphery of the opening.

It may be that the first liner is an inside liner and the inner surface of the first liner receives a body part of a wearer via the at least one opening. For example, the liner may be an inside liner of a shoe in which a user puts their foot. It may be that the liners are manufactured in an inside out configuration, that is, the first and second liners are reversed in order during the manufacturing process. It may be that the liners are then inverted to a final configuration. In this case, the second liner receives a body part of a wearer via the at least one opening, for example the foot, in the case of a shoe.

Typically the first and second liners, with the layer of cured resin therebetween, is formed into a garment, for example a shoe, giving a waterproof garment. Typically, the garment has an opening and a waterproof body portion which encompasses a wearer's body part (e.g. foot) introduced through the opening in use.

More generally, the waterproof garment may be footwear or headgear or a glove. That is, the waterproof garment may be, for example, a shoe or boot, a hat or a glove, a jacket or a pair of trousers.

For example, it may be that the waterproof garment is a jacket. The first and second liners and the cured resin therebetween may form at least part of a body portion of the jacket. It may be that the body portion of the jacket is formed by a continuous piece of fabric, that is the jacket does not have a zip. It may be that the waterproof garment is a pair of trousers. The first and second liners and the cured resin therebetween may form at least a part of the legs of the trousers. It may be that the waterproof garment is a glove, wherein the first and second liners are shaped to fit around a wearer's hand and fingers. It may be that the waterproof garment is a hat, wherein the first and second liners are shaped to fit a wearer's head (i.e. fit onto the wearer's head).

It may be that the resin is a thermosetting resin. In other words, the resin is cured when subjected to heat, i.e. a heat-curable resin. That is, the resin becomes hardened when subjected to heat thereby forming a hardened layer on the first liner. It may be that the resin is a photo-curable resin, i.e. a photopolymerisation resin. In other words, the resin is cured when subjected to light, i.e. the resin is cured by light or photo-initiated. That is, the resin becomes hardened when subjected to light thereby forming a hardened layer on the first liner.

It may be that the resin is a polymeric agent (e.g. agents which comprise monomers and/or copolymers), or an epoxy resin. It may be that the resin is polyurethane, preferably liquid polyurethane (e.g. a solvent-based liquid polyurethane or a water-based liquid polyurethane) which provides a resin with a lower viscosity allowing the resin to be applied by methods which would otherwise be impractical for a high viscosity resin, such as spraying. It may be that the resin is thermoplastic polyurethane. It may be that the resin is a polyester resin. It may be that the resin is an acrylic resin. It may be that the resin is a fluoroplastic resin, e.g. a polytetrafluoroethylene (PTFE) based resin.

It may be that the resin, when cured, allows moisture to pass through the first liner in one direction only, e.g. from the inner surface to the outer surface of the first liner. It may be that moisture passes through the first liner in response to a temperature differential. That is, the moisture passes from a hot side of the first liner to a cooler side, e.g. from the side of the first liner with a wearer's body part to an outer side of the liner.

It may be that curing the resin comprises heating the coated first liner. It may be that heating the coated first liner comprises placing the coated first liner near a heat source, such as into an oven. It may be that heating the coated first liner comprises using a heat gun, or the like. That is, the curing process may be localised to the areas which are coated with the resin rather than subjecting the whole first liner to the heat. It may be that the oven is heated before the coated first liner is placed inside, i.e. the oven is pre-heated. It may be that the coated first liner is placed into the oven for a predetermined length of time at a predetermined temperature.

It may be that curing the resin comprises subjecting the coated first liner to light, e.g. by shining light onto the coated first liner. That is, the resin is photo-cured. It may be that the wavelength of the light to cure the resin is in the UV range of the electromagnetic spectrum, e.g. from a UV light source. It may be that the light is applied to the coated areas of the first liner. That is, the curing process may be localised.

It may be that coating the first liner with a resin comprises coating the outer surface of the first liner but the inner surface of the first liner is not coated with resin.

It may be that the first liner is fitted onto a mechanical form prior to coating with the resin to maintain the shape of the liner. For example, it may be the first liner is for a shoe or boot and the mechanical form is a last or the like.

It may be that the method comprises one or more steps of removing excess resin from the first liner prior to curing the coated first liner. That is, an excess amount of resin may be used to coat the first liner thereby coating all the required surface. It may be that removing the excess resin is by brushing the coated first liner. Alternatively, or in addition, it may be that removing the excess resin is by absorbing the excess resin with a fabric, e.g. a sponge or the like. Alternatively, or in addition, it may be that removing the excess resin is by vibrating the coated first liner. Alternatively, or in addition, it may be that removing the excess resin is by shaking the coated first liner. Alternatively, or in addition, it may be that removing the excess resin is by spinning the coated first liner. Alternatively, or in addition, it may be that removing the excess resin is by blowing air over the coated first liner, e.g. be placing the coated first liner into the path of an air flow. It may be that the air is cold air, such that the air flow causes or encourages the excess resin to drip off the first liner. Alternatively, it may be that the air is heated. Alternatively, or in addition, it may be that removing the excess resin is by positioning and leaving the coated first liner such that the excess resin may drip off the coated first liner. It may be that the coated first liner is left for a predetermined length of time dependent on the viscosity of the resin.

It may be that the method comprises coating the coated first liner (i.e. the first liner with a layer of cured resin) with one or more subsequent layers of resin. That is, the first liner is re-coated. It may be that the resin for the one or more subsequent layers of resin is the resin used for the first coating of the first liner or a further resin. That is, the one or more subsequent layers of resin is formed using one or more resins different from the resin used for the first layer of cured resin. For example, the resin used for the first layer of cured resin may be a heat-curable resin and the one or more resins used for the one or more subsequent layers of resin may be a light-curable resin. It may be that the resin for the one or more subsequent layers of resin has a different viscosity such that the thickness of the one or more subsequent layers is different from the thickness of the first layer of resin. The one or more subsequent layers of resin are then cured according to the resin or further resin used to form a plurality of layers of cured resin on the first liner.

It may be that the resin or the further resin of the one or more subsequent layers of resin is a thermosetting resin. It may be that the resin or the further resin of the one or more subsequent layers of resin is a photo-sensitive resin, i.e. a photopolymerisation resin. It may be that the resin or the further resin of the one or more subsequent layers of resin is a polymeric agent or an epoxy. It may be that the resin or the further resin of the one or more subsequent layers of resin is polyurethane, typically liquid polyurethane (e.g. a solvent-based liquid polyurethane or a water-based liquid polyurethane). It may be that the resin or the further resin of the one or more subsequent layers of resin is thermoplastic polyurethane. It may be that the resin or the further resin of the one or more subsequent layers of resin is a polyester resin. It may be that the resin or the further resin of the one or more subsequent layers of resin is an acrylic resin. It may be that the resin or the further resin of the one or more subsequent layers of resin is a fluoroplastic resin, e.g. a polytetrafluoroethylene (PTFE) based resin.

It may be that the resin or the further resin of the one or more subsequent layers of resin, when cured, allows moisture to pass between the inner and outer surfaces of the first liner. It may be that the resin or the further resin of the one or more subsequent layers of resin allows moisture to pass between the surfaces of the first liner in response to a temperature differential.

It may be that curing the one or more subsequent layers of resin comprises heating the re-coated first liner, e.g. by placing the re-coated first liner into an oven. It may be that heating the coated first liner comprises using a heat gun, or the like. That is, the curing process may be localised to the areas which are coated with the resin rather than subjecting the whole first liner to the heat. It may be that the oven is heated before the re-coated first liner is placed inside, i.e. the oven is pre-heated. It may be that the re-coated first liner is placed inside the oven for a predetermined length of time at a predetermined temperature.

Alternatively, it may be that curing the one or more subsequent layers of resin on the first liner comprises subjecting the re-coated first liner to light, e.g. by shining UV light, for example, from a UV light source.

It may be that the method comprises testing the coated first liner after the resin has cured to determine the waterproofness of the first liner. It may be that the testing is performed before one or more subsequent coatings of resin is applied. It may be that the testing is performed after one or more subsequent coatings of resin is applied. It may be that testing the coated first liner comprises filling the first liner with air and submerging or dunking the first liner into a tank of water. It may be that testing the coated first liner comprises filing the first liner with water and forcing air into the first liner. It may be that testing the coated first liner comprises determining defects or faults of the coating on the first liner.

It may be that the method comprises the step of coating determined defects or faults of the coating on the first liner with the resin and curing the coated defects or faults. That is, the first liner, or one or more sections of the first liner, is re-coated to seal points of defects or faults. Alternatively, it may be that the method comprises the step of coating determined defects or faults of the coating on the first liner with a further resin and curing the coated defects or faults. That is, a different resin may be used to coat determined defects in the coating on the first liner, i.e. to seal points of defects or faults. For example, a further resin may be used to coat, i.e. patch, the determined defects, the further resin being one which can be locally cured (i.e. the curing process can be applied to specific areas on the first liner). The different resin may be one of a thermosetting resin, a photo-sensitive resin, polyurethane or a derivative thereof, for example a polyurethane glue, a polyester resin, an acrylic resin, or a fluoroplastic resin, for example a PTFE based resin.

It may be that the re-coated first liner is tested to check that the liner is waterproof. It may be that testing the re-coated first liner comprises filling the first liner with air and submerging or dunking the first liner into a tank of water. It may be that testing the re-coated first liner comprises determining defects or faults of the coating on the first liner. It may be that testing the re-coated first liner comprises filling the first liner with water and forcing air into the first liner.

It may be that the method comprises fitting an external covering on the first and second liners. It may be that the external covering completely covers the first and second liners; that is the first and second liners are towards a body part of the wearer and that the first and second liners form (may function as) a waterproof lining for the finished garment. Alternatively, it may be that the first and second liners form at least 50% of the exterior surface area of the finished garment. That is, the exterior surface area of the finished garment comprises the external covering and the first and second liners. It may be that the first and second liners are toward a body part of the wearer and at least 50% of the exterior surface area of the finished garment is formed of the first and second liners. Typically the innermost of the first and second liners defines the body-receiving interior of the garment. Typically the second liner is outermost and the first liner is innermost, unless the first and second liners have been turned inside out during manufacture in which case it is the other way round.

It may be that the outermost of the first and second liners comprises an additive to alter the appearance of the finished garment when subjected to light of particular wavelengths. For example, the additive may be an optical brightener (or brightening) agent which gives the finished garment the appearance of being whiter when subjected to light in the UV range of the spectrum (e.g. light from a black light or another UV light source).

It may be that the garment is a shoe, and that the method comprises fitting the liners, comprising the first and second liners, into an upper (e.g. where the upper is an external covering). It may be that the upper is a knitted upper, leather, synthetic leather, textile or any combination thereof. It may be that the upper is a Strobel shoe or boot.

Alternatively, it may be that the first and second liners form the upper of the garment.

It may be that the method comprises the step of applying an anti-mould treatment to the upper. It may be that the method comprises the step of applying a water-repellent treatment, e.g. a high-quality durable water repellent (DWR), to the upper.

In a fourth aspect of the invention there is provided a waterproof garment, comprising a first liner and a second liner, with the first liner fitted within the second liner or vice versa, the first liner having a waterproof layer formed on the surface of the first liner facing the second liner. (When the first liner is within the second liner, the waterproof layer is on the outer surface of the first liner. When the second liner is within the first liner, the waterproof layer is on the inner surface of the first liner). The first and second liners are typically each a continuous body of fabric shaped to enclose a body part of a wearer (e.g. a wearer's foot).

In some embodiments, the innermost of the first and second liners forms the internal lining of the finished garment. In some embodiments, the outermost of the first and second liners form at least a part of an exterior covering of the finished garment. In some embodiments, the first and second liners form a waterproof internal lining of the garment (for example the first and second liners may be completely covered by an external covering). That is, the first and second liners may form (may function as) a waterproof lining for the garment (e.g. a shoe). In some embodiments, the first and second liners form at least part of an exterior covering of the garment. Typically, the waterproof layer is a cured resin layer.

The waterproof garment may be footwear or headgear or a glove. That is, the waterproof garment may be, for example, a shoe or boot, a hat or a glove, a jacket or a pair of trousers.

For example, it may be that the waterproof garment is a jacket. The first and second liners and the cured resin therebetween may form at least part of a body portion of the jacket. It may be that the body portion of the jacket is formed by a continuous piece of fabric, that is the jacket does not have a zip. It may be that the waterproof garment is a pair of trousers. The first and second liners and the cured resin therebetween may form at least a part of the legs of the trousers. It may be that the waterproof garment is a glove, wherein the first and second liners are shaped to fit around a wearer's hand and fingers. It may be that the waterproof garment is a hat, wherein the first and second liners are shaped to fit a wearer's head (i.e. fit onto the wearer's head).

The first liner is typically in the form of a closed tube. The first liner is configured to receive a body part of a wearer (e.g. foot, in the case of a shoe) through the opening. The first liner may be in the shape of a bootie. The first liner may comprise a heel portion. The first liner may comprise a toe portion.

Typically, the first liner comprises at least two pieces of fabric sewn together, thereby forming one or more seams in the first liner. Typically, the one or more seams in the first liner is formed by stitching the at least two pieces of fabric.

The cured resin layer may comprise a polymer such as polyurethane or PTFE.

The waterproof layer may extend across at least 50%, at least 75%, at least 90% or all of the surface area of the first liner.

Where the first liner is a closed tube, the waterproof layer may extend across the whole of the closed tube, or the whole of the closed tube except for a sleeve portion extending around and defining the opening.

The first liner may comprise a closed tube having a sleeve portion and a body portion which encloses a body part of a wearer, e.g. a foot, when in use. It may be that the body portion is entirely coated with the waterproof layer. It may be that the sleeve portion (also known as a throat in the case of shoes) is not entirely coated with the waterproof layer.

Typically, the first liner is nested within the second liner or vice versa. The second liner may be attached, e.g. adhered to the first liner. The second liner may be adhered to and thereby cover the layer of cured resin. It may be that the second liner protects the layer of cured resin from abrasion. It may be that the second liner prevents debris (such as grit, stones or dust) from contacting the layer of cured resin. That is, the cured resin forms a layer on a surface of the first liner and the second liner covers the layer of cured resin, thereby reducing damage to the cured resin by abrasion or debris.

It may be that the first and second liners form (may function as) an internal waterproof lining of the garment; that is, the first and second liners are towards a body part of the wearer and the finished garment comprises an external covering which covers the first and second liners (e.g. the external covering completely covers the first and second liners).

It may be that the first and second liners form at least a part of an exterior covering of the garment; that is, the first and second liners are toward a body part of the wearer and at least 50% of the exterior surface area of the garment is formed of the first and second liners. The garment may further comprise an additional external covering which covers the first and second liners, such that the first and second liners form at least 50% of the exterior surface area of the garment.

It may be that the outermost of the first and second liners comprises an additive to alter the appearance of the finished garment when subjected to light of particular wavelengths. For example, the additive may be an optical brightener (or brightening) agent which gives the finished garment the appearance of being whiter when subjected to light in the UV range of the spectrum (e.g. light from a black light or another UV light source).

Typically, the second liner has an inner surface, an outer surface and an opening. The second liner may be in the shape of a bootie. The second liner may comprise a heel portion. The second liner may comprise a toe portion. Typically, the second liner is seamless. Typically, the second liner is formed of a continuous body of material without seams. The second liner may be formed of a textile material such as a woven or non-woven textile. However, typically, the second liner is formed by circular knitting. The second liner is typically a circular knitted liner. The second liner is typically a seamless closed tube, for example a seamless closed tube formed by circular knitting. The first and/or second liners may be formed from woven textiles which comprise stretch fibres or elastic fibres.

The first liner and/or second liner may be made from polyester. It may be that the first liner and/or second liner are made from a polyester blend, e.g. polyester blended with stretch or elastic fibres. It may be that the first liner and/or second liner are made from wool or a wool blend. It may be that the second liner is made by circular knitting and the material used is any material suitable for circular knitting. It may be that the weight and/or thickness of the material for the first liner and second liner are the same. It may be that the weight and/or thickness of the material for the first liner and second liner are different. It may be that the first liner and/or second liner are formed of a textile material such as a woven textile or a knitted textile. The first liner may be made from a laminate (e.g. comprising at least two layers of material). It may be that the laminate comprises a textile layer and a foam layer. The first liner may be made from a waterproof laminate fabric comprising two or more layers. It may be that the waterproof laminate fabric comprises three layers. It may be that the three layers of the waterproof laminate fabric is a face layer, a membrane (e.g. a polytetrafluoroethylene-based membrane such as eVENT® Fabric) and a bonding layer (e.g. a nylon-based layer such as a tricot layer).

It may be that the second liner is formed of a material which is water permeable. The second liner may be formed of a material which is not waterproof, that is, liquid water may pass through, i.e. between the inner and outer surfaces of the second liner. Typically, the second liner has no waterproof coating thereon. It may be that the second liner is coated with an anti-mould preparation. It may be that the second liner is coated with a water-repellent treatment, e.g. a high-quality durable water repellent (DWR).

Typically, the first and second liners are fitted together such that the layer of cured resin is located between the first and second liners. The first and second liners may be joined, e.g. attached, together. It may be there is adhesive between the first and second liners (e.g. between a surface of the second liner and the cured resin layer of the first liner). It may be that the first and second liners are adhered together by welds or adhesive. However, it may be that the first liner fits within the second liner or vice versa without being adhered to the second liner.

It may be that the first and second liners are joined with stitches, e.g. around the opening, for example the second liner may be joined to the sleeve region of the first liner, for example by stitching or welding. It may be that where the first and second liners are joined forms a topline around the top of the opening. It may be that a webbing or textile tape is applied where the first and second liners are attached to give a (e.g. neat) finished look.

It may be that the first liner is coated with one or more layers of one or more resins. The first liner may be coated with a plurality of layers, of the same or different resins.

The first liner and/or second liner may be made in discrete sizes with stretch or elastic fibres allowing the resulting garment to fit comfortably onto the wearer. For example, the first liner may be for shoes and the dimension of the liner may be selected from a group of dimensions for discrete foot sizes.

It may be that the second liner comprises a collar which is fitted over the first and second liners around at least some of the periphery of the opening.

It may be that the first liner is an inside liner and the inner surface of the first liner receives a body part of a wearer via the at least one opening. For example, the liner may be an inside liner of a shoe in which a user puts their foot. However, where the second liner is within the first liner, the second liner receives a body part of a wearer via the at least one opening, for example the foot, in the case of a shoe.

The invention extends in a fifth aspect to a waterproof shoe comprising the first and second liners and the cured resin layer of the first aspect. Typically, the shoe has an opening and a waterproof body portion which encompasses a wearer's foot introduced through the opening in use.

The shoe may further comprise an upper. It may be that the upper is a knitted upper, leather, synthetic leather, textile or any combination thereof. The upper may be coated with an anti-mould preparation. The upper may have a water resistant coating. The upper may be a Strobel shoe or boot. The upper may be adhered to the second liner (where the first liner is within the second liner) or the first liner (where the second liner is within the first liner).

However, the second liner (where the first liner is within the second liner) or the first liner (where the second liner is within the first liner) may function as an upper and/or may be exposed on the surface of the shoe. That is, the outermost of the first and second liners may function as an upper and/or may be exposed on the surface of the shoe. It may be that at least 50% of the exterior surface area of the shoe is formed by the first and second liners.

The shoe may further comprise a sole. The shoe may further comprise eyelets for laces. The eyelets may be connected to the sole. The eyelets may be formed on the second liner (where the first liner is within the second liner) or the first liner (where the second liner is within the first liner). That is, the eyelets may be formed on the outermost of the first and second liners. The eyelets may be formed on the second liner (where the first liner is within the second liner) before the second liner covers the first liner, or first liner (where the second liner is within the first liner) before the first liner covers the second liner. The shoe may further comprise a topline.

The shoe may further comprise a heel portion. The shoe may further comprise a toe portion.

The sole may be fitted directly to the second liner (where the first liner is within the second liner) or the first liner (where the second liner is within the first liner). That is, the sole may be fitted on the outermost of the first and second liners. The sole may be fitted directly to the second liner (where the first liner is to be within the second liner) before the second liner covers the first liner or to the first liner (where the second liner is to be within the first liner) before the first liner covers the second liner.

In some embodiments, the first and second liners together form a bootie for the shoe, wherein the bootie is for receiving a wearer's foot. The shoe may be a boot (e.g. a hiking boot). The boot may comprise a sole and an upper.

The shoe may be formed from first and second seamless circular knitted liners, the first liner having a waterproof layer thereon, on the surface facing the second liner, and a sole, can be made cheaply and easily while being waterproof.

It may be that the upper is attached by means of a cemented construction. That is, the upper is attached by means of adhesives rather than stitches. Alternatively, it may be that the upper is attached by means of stitches, e.g. Strobel stitches. Alternatively, it may be that the upper is attached by a combination of adhesives and stitches.

The invention also extends in a sixth aspect to a waterproof shoe comprising the first and second liners and the cured resin layer of the second aspect. The invention also extends in a seventh aspect to a waterproof garment made by the method of the first aspect of the invention and in an eighth aspect to a waterproof garment made by the method of the second aspect of the invention.

Optional features discussed in respect of any aspect of the invention are optional features of each aspect of the invention.

DESCRIPTION OF THE DRAWINGS

An example embodiment of the present invention will now be illustrated with reference to the following Figures in which.

DETAILED DESCRIPTION OF AN EXAMPLE EMBODIMENT

We will now describe a first example of a waterproof garment, specifically a shoe, and a method of making the garment with reference to FIGS. 1 to 5.

Figure 1:
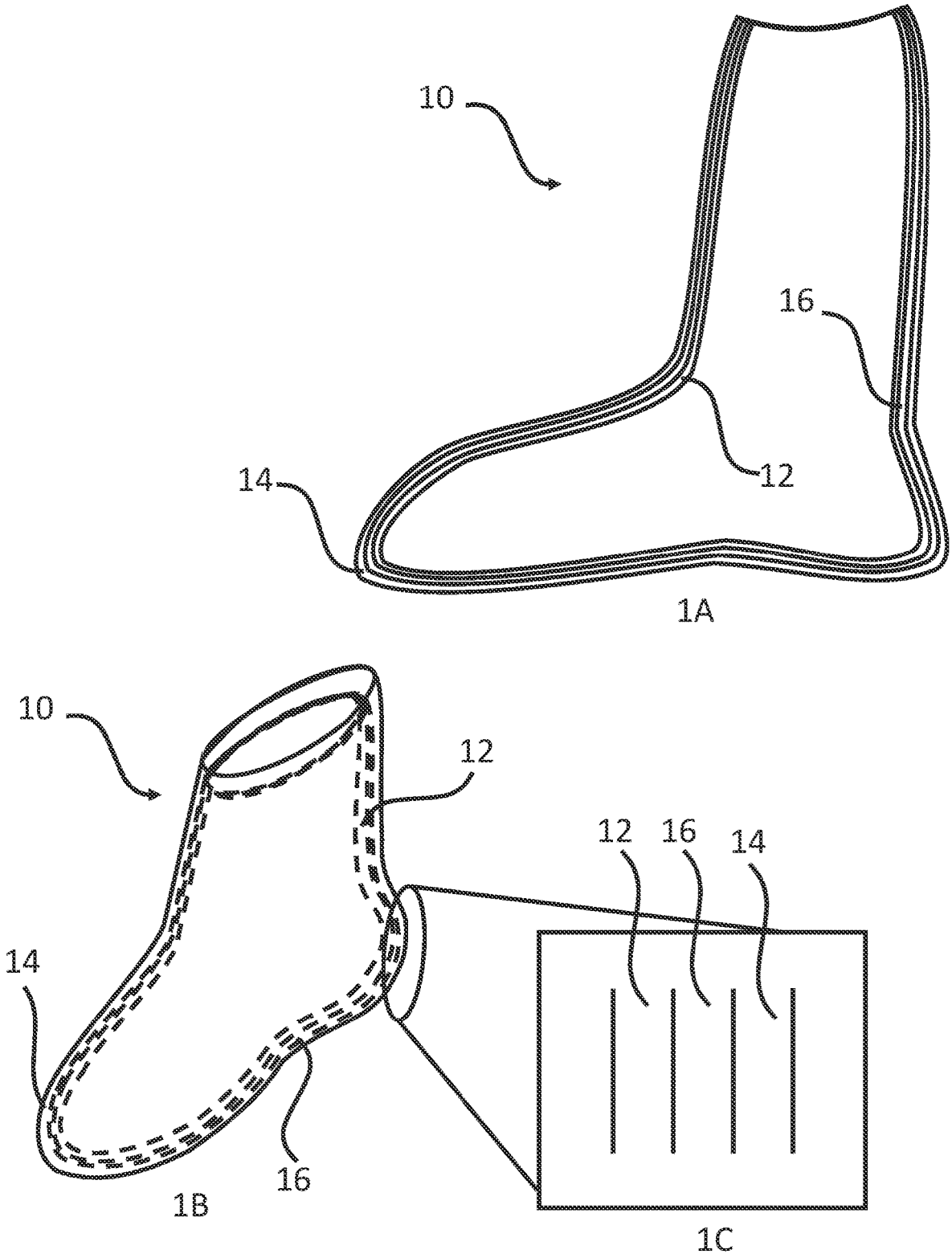
FIGS. 1A and B are schematics of combined liners in the shape of a bootie for a shoe.
FIG. 1C is a schematic of combined liners showing an inside liner, an outside liner, and a layer of cured resin between the inside and outside liners.

FIG. 1 shows a schematic of a cross-section view of combined liners (10) for a shoe (1A), a schematic of the combined liners (10) (1B), and an exploded cross-section view of the combined liners (10) (1C). The combined liners (10) comprises an inside liner (12), an outside liner (14) and a layer of cured resin (16) between the inside (12) and outside (14) liners. The dotted lines of FIG. 1B depict that the insider liner (12) and the layer of cured resin (16) are inside the outside liner (14). The inside liner (12) is made of a material which itself is water permeable and so not waterproof. However, the layer of cured resin (16) is water proof and this prevents liquid water from passing into the internal cavity of the combined liners (10), i.e. where a wearer's foot would be located when the shoe is worn, through the inside liner (12). That is, the layer of cured resin (16) causes the inside liner (12) to be waterproof. The combined liners (10) further comprise an opening (18) so that the combined liners (10) can be fitted onto a wearer's foot.

In this example, the inside liner (12) and outside liner (14) are each circular knitted liners. That is, the majority of the liner is composed of one continuous body of textile which is seamless, rather than made by stitching together a plurality of pieces of material. In contrast to methods of forming shoes by stitching laminates known in the art, the combined liners (10) therefore comprises a liner which is not formed from several pieces of material stitched together and does not require waterproof tape to cover the seams formed from the stitches in order to be waterproof.

The layer of cured resin is applied to the circular knitted liner (as will be described in further detail below). If both liners are a circular knitted liner, then the layer of cured resin may be on either liner (on the outer surface of the inner liner or the inner surface of the outer liner). The combined liners (10) therefore have the layer of cured resin between the two liners (usually extending into the surface of one of the liners) such that it is protected from abrasion or debris, for example from the wearer's foot or gravel which might otherwise accumulate on the outer surface of the lining, underneath any upper which may be present.

FIG. 1C also shows an exploded cross-section showing the distinct layers which make up the combined liners (10). In particular, the inside liner (12) comprises an inner surface (i.e. the surface facing towards the internal cavity of the combined liners (10)) and an outer surface. The outer surface of the inside liner (12) is in contact with the layer of cured resin (16). The outside liner (14) also comprises an inner surface and an outer surface, wherein the inner surface of the outside liner (14) is in contact with the layer of cured resin (16).

Figure 2:
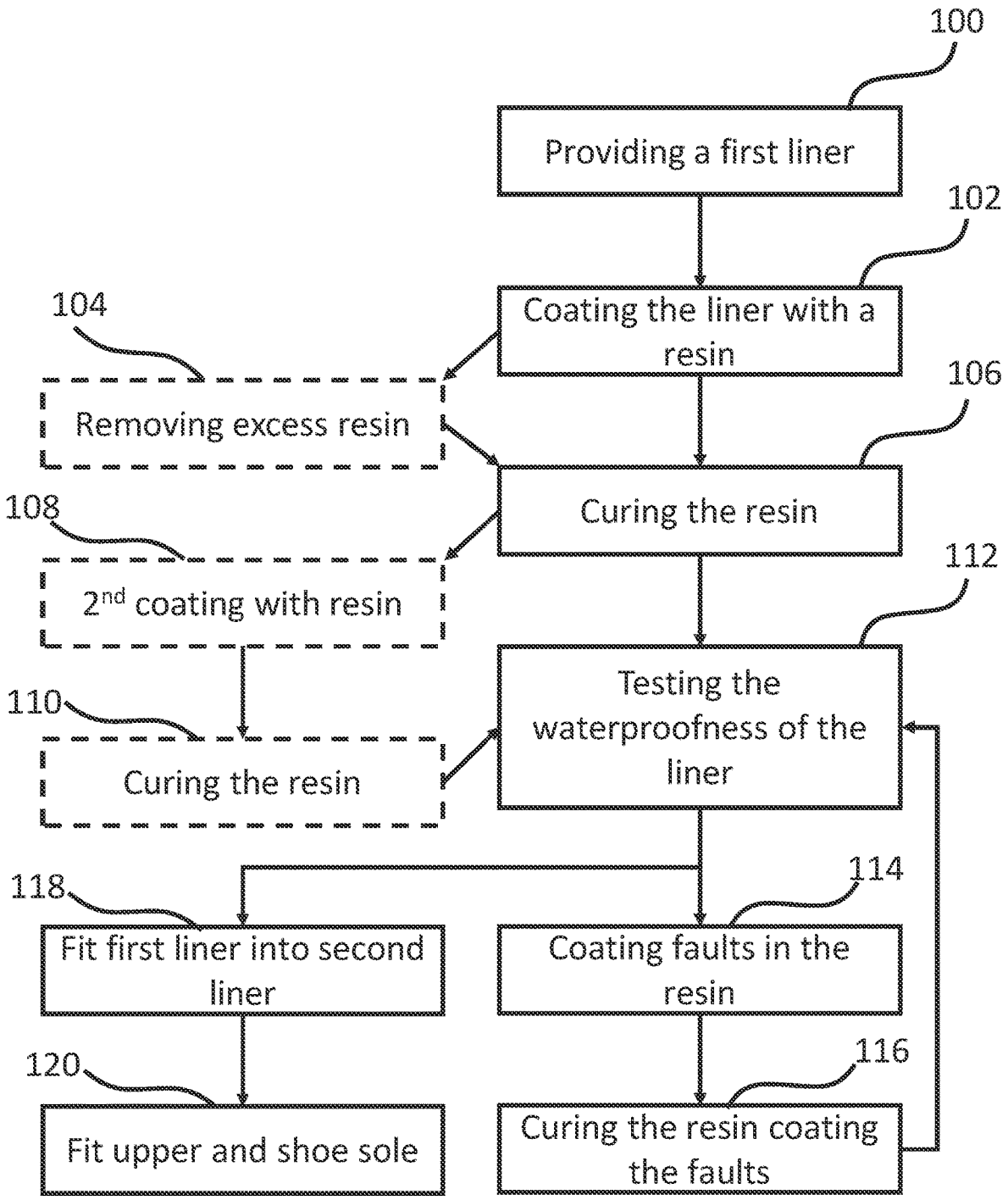
FIG. 2 is a flowchart for a method of constructing a waterproof garment.
Figure 3:
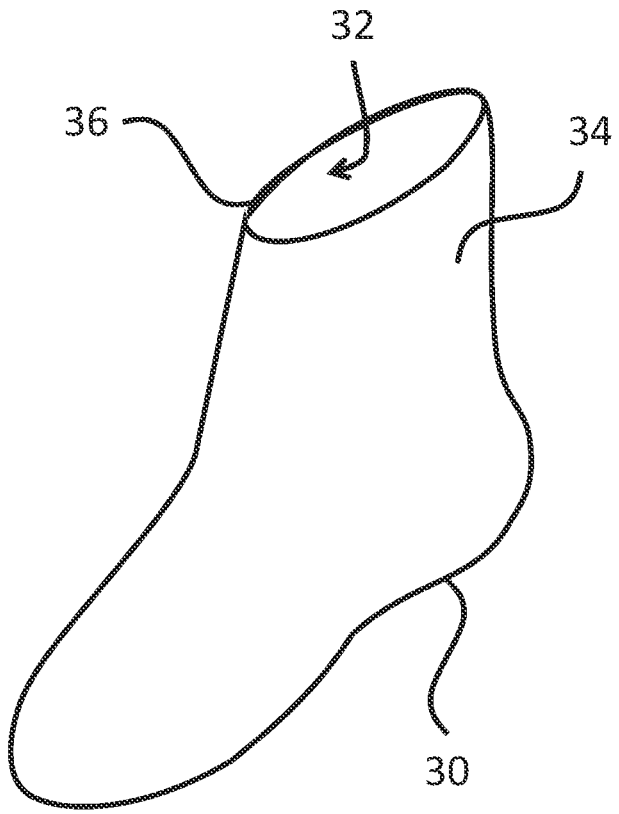
FIG. 3 is a schematic of a first liner for a shoe.

FIG. 2 shows a flowchart for constructing a waterproof garment, in this case a shoe. In step (100), a first liner is provided. In this example embodiment, the first liner is a circular knitted liner. Typically, this first liner is not waterproof. An example is shown in FIG. 3, wherein the first liner (30) is a liner for a shoe, such as the inside liner (12) of FIG. 1A. Similar to the inside liner (12) of FIG. 1A, the first liner (30) comprises an inner surface (32), an outer surface (34) and an opening (36).

The first liner of step (100) is then coated with a resin in step (102). The resin may, for example, be a thermosetting resin or a photo-sensitive resin. The coating process may be one of several different methods, including brushing, painting, spraying or dipping. That is, the resin is a viscous substance which can coat a surface of the first liner.

Optionally, excess resin may be removed from the first liner in step (104) while the resin remains viscous (i.e.

before the resin is cured or has hardened). For example, the excess resin may be removed by brushing the excess off the liner; absorbing the excess; vibrating, shaking or spinning the liner; or by blowing air over the liner. This may result in a more uniform coating of resin on the first liner. This may also result in a thinner layer of resin.

Figure 4:
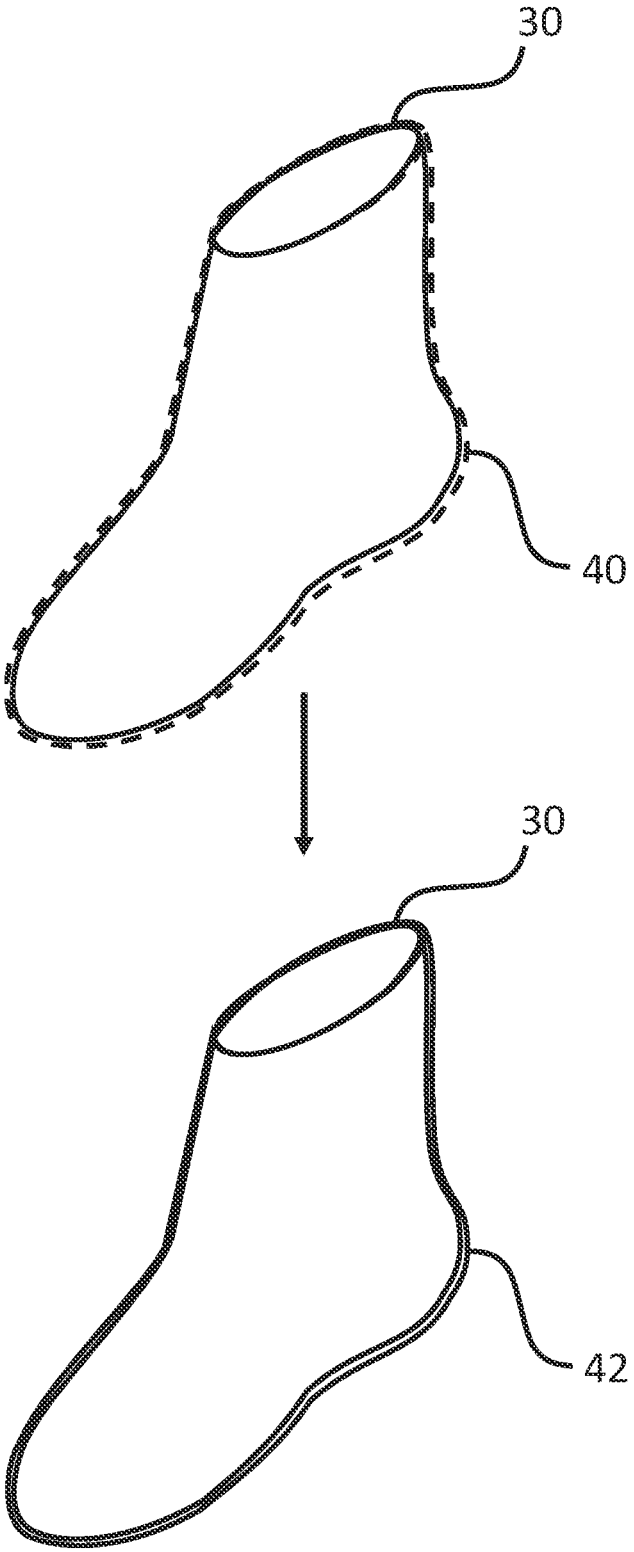
FIG. 4 is a schematic of the first liner of FIG. 3 coated with a resin and a layer of cured resin on the first liner.

Step (102), and optionally step (104), is followed by step (106) wherein the resin is cured. The curing process hardens the viscous resin to form a hardened layer. An example of steps (102) and (106) are depicted in FIG. 4, wherein the outer surface (34) of the first liner (30) of FIG. 3 is coated with a resin (40) and the resin is cured to form a layer of cured resin (42). That is, curing the resin causes the resin to become hardened. The layer of cured resin (42) thereby makes the first liner (30) waterproof.

The curing process depends on the resin used to coat the liner. For example, if the resin is a thermosetting resin then the curing process is a heat treatment, e.g. the liner is placed inside an oven. The oven may be preheated to a predetermined temperature and the liner is placed inside the oven for a predetermined length of time. Alternatively, the heat treatment may be use of a heat gun to cure the resin at local points on the liner, that is the curing process is localised.

If the resin is alternatively a photo-sensitive resin, the curing process is by subjecting the first liner to light. For example, the light may be UV light, e.g. from a UV light source. It may be that the whole liner is subjected to light at the same time, e.g. by placing the liner into a light box, or the curing process is localised.

The resin may be cured globally (i.e. the whole liner is subjected to the necessary curing treatment—e.g. the whole liner is placed inside an oven), or cured locally (i.e. sections of the liner is subjected to the necessary curing treatment—e.g. by use of a heat gun to cure a section of the coated liner).

Regardless of the resin used, the curing process causes the resin to cure (i.e. harden) to form a layer of cured resin (42). This layer of cured resin (42) covers the outer surface (34) of the first liner (30). The layer of cured resin (42) could alternatively cover particular portion(s) of the first liner (30). For example, a portion (e.g. a sleeve portion) around the opening (36) of the first liner (30) may be left uncoated by the resin (not shown).

Although the first liner (30) is depicted as being an inside liner in FIGS. 3-4, the present invention also recognises that the first liner (30) may be an outside liner in the finished product by turning the liners inside out.

After step (106), in some embodiments there is an additional step of coating the first liner for a second time with resin in step (108). The resin used for the second coating may be the same resin as that used for the first coating (step 102), or may be a different resin. For example, the resin used for the first coating may be a thermosetting resin whereas the resin used for the second coating is a photo-sensitive resin. The thickness of the second coating may be different from the first coating. The method would then proceed to step (110) in which the second coating is cured according to the type of resin used to form a second layer of cured resin. It may be that the whole liner is subjected to the curing process, or it may be that the curing process is localised. Optionally, the steps of (108) and (110) may be performed any number of times.

Figure 5:
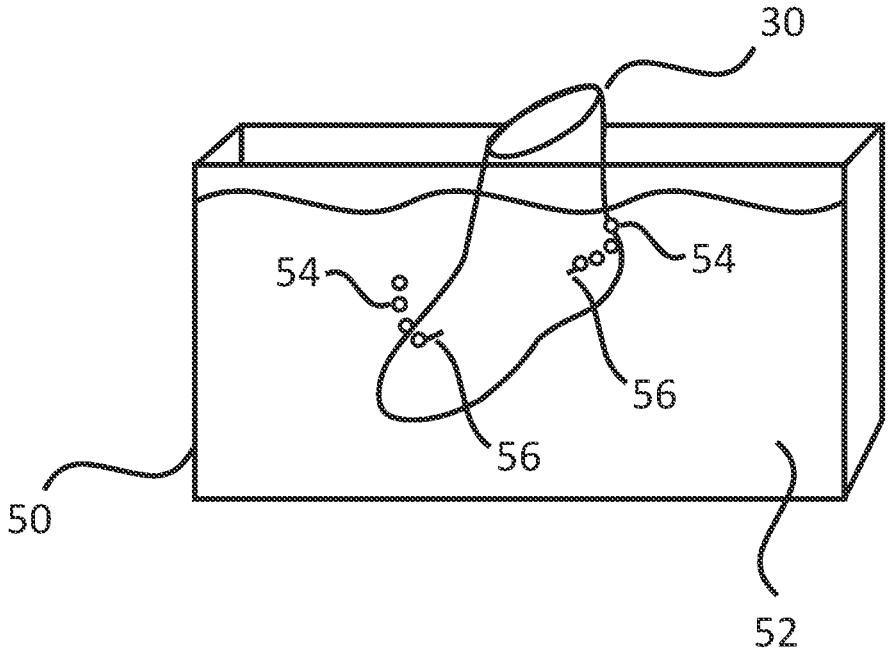
FIG. 5 is a schematic of the first liner with a layer of cured resin of FIG. 4 being tested for defects.

If a second or any number of additional coatings of resin is not applied, or after the second or any number of additional coatings of resin is cured (step 110), the method proceeds to step (112) in which the waterproofness of the first liner is tested. An example of testing the first liner is shown in FIG. 5. The testing process includes filling the first liner (30) with air, typically to a pressure of around 1 psi, and submerging (or dunking) the first liner (30) into a tank (50) of water (52) to inspect for any air bubbles (54) escaping from the first liner (30). If air escapes the first liner (30), then it is determined that there are defects (56) in the layer of cured resin. The first liner (30) is repaired (i.e. the defects are corrected) by applying a localised coating of resin over the defects (56) in step (114). The resin may be applied by any method described in relation to step (102).

The resin covering the defects in the first liner are then cured in step (116); cured by means in accordance with the resin used, e.g. a heat treatment for a thermosetting resin. It may be that particular resins are preferred for such localised coatings, e.g. a polyurethane glue. The liner is then retested to ensure that the faults have been correctly coated and that the liner is waterproof. The steps of (112)-(116) may be iterative until the liner has been determined to be waterproof. It may be that steps (112)-(116) are performed a maximum number of times—that is there may be a maximum number of times a liner is recoated and tested before it is determined to be un-repairable.

Once the liner has been determined to be waterproof, a second liner is pulled over the first liner (step 118). The second liner is also a circular knitted liner. The two liners are adhered together, e.g. by an adhesive or by stitches. For use of an adhesive, the adhesive is applied to the layer of cured resin and the inner surface of the second liner. The cured layer of resin could in principle be used to adhere the liners although it would be at risk of being damaged by the process of pulling the second liner over the first liner.

Figure 7:
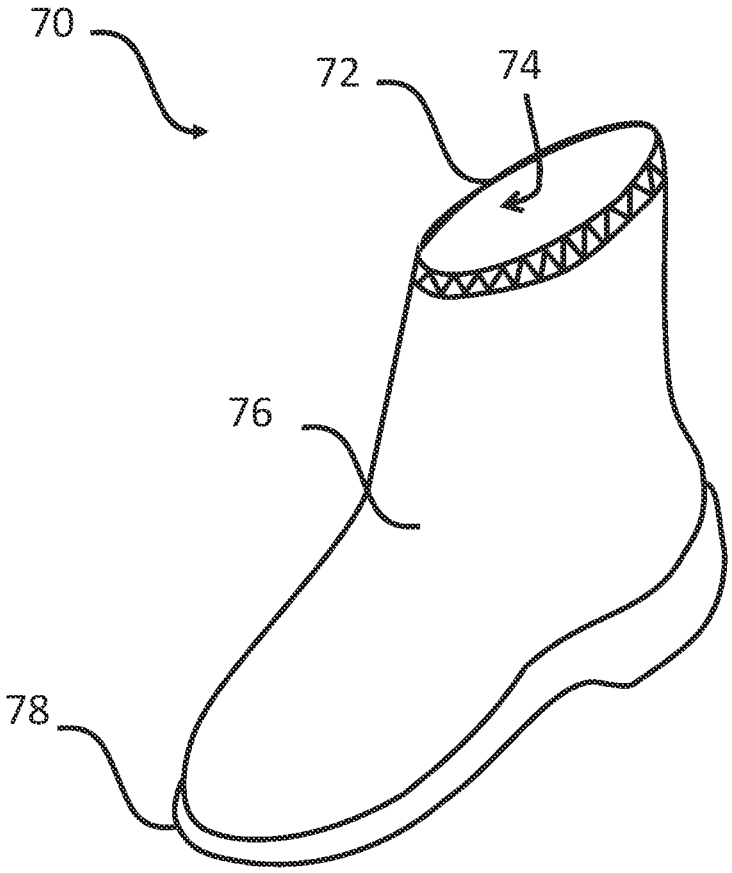
FIG. 7 is a schematic of a shoe with an upper and a sole.

Thus, the first liner is an inner liner and the second liner is an outer liner, and the layer of cured resin is protected between the inner and outer liner. In some embodiments, the first and second liners are turned inside out together, so that the second liner is on the inside of the first liner, after the second liner has been fitted around the first liner having a layer of cured resin. The first and second liners still protect the layer of cured resin therebetween which provides a waterproof shoe.

Where the first liner is for a shoe, the construction of the waterproof shoe is completed by fitting the adhered liners with a shoe sole (step 120), FIG. 7 shows a completed shoe. It may be that the first and second liners function as a waterproof internal lining and the waterproof shoe is completed by fitting an upper in step (120). It may be that the first and second liners function as the upper of the finished shoe, in which case no upper is fitted in step (120). It may be that fitting the shoe sole includes fitting an in-sole into and an outsole onto the shoe. The outsole is fitted directly to the knitted base of the adhered liners (the base of the second liner, unless the first and second liners have been turned inside out in which case the outsole can be fitted directly to the knitted base of the first liner). The in-sole is fitted into the adhered liners, i.e. into the first liner (or second if the first and second liners have been turned inside out).

The upper and shoe sole are to be fitted according to practices known in the art. It is advantageous to have the waterproof cured layer sandwiched between the first and second liners where there is also an upper as, in known shoes (e.g. hiking shoes) with a waterproof bootie having an outer surface which is waterproof, and an upper, grit can penetrate the upper and cause damage to the waterproof bootie. In the present case, the outer liner will provide further protection for the waterproof cured layer.

The aesthetics of the shoe may then be altered, e.g. by applying additional fabrics to the outside of the shoe (not shown). The shoe may also be fitted with a topline. The topline may be formed using a part of the adhered liners. It may be that the part of the adhered liners used to form a topline was not coated with the resin during step (106). It may, alternatively or in addition, be that the second liner comprises a collar from which the topline is formed.

Figure 6:
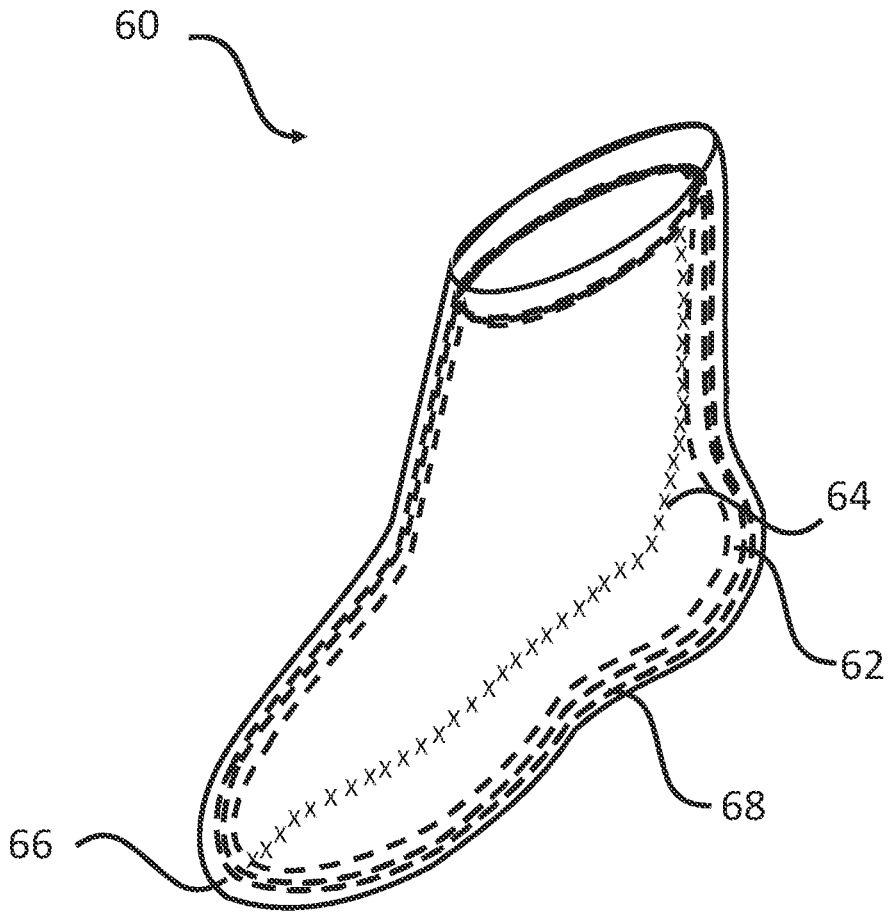
FIG. 6 is a schematic of combined liners in the shape of a bootie for a shoe according to a second example.

An example of the third and fourth aspects of the invention is now described with reference to FIG. 6. FIG. 6 shows combined liners (60) similar to the combined liners (10) of FIG. 1B. However, the combined liners (60) of the third and fourth aspects comprise a first liner (62) which is made from at least two pieces of fabric sewn together. It may be that the fabric is not waterproof in itself. The first liner (62) has been formed by pieces of the fabric being stitched together (64). The stitches are depicted as dotted lines, and may run along the bottom and back of the first liner (62).

The combined liners (60) also comprise a second liner (66), which is a circular knitted liner, and a layer of cured resin (68) between the first (62) and second liners (66). Whereas the combined liners (10) of FIG. 1A was coated by a resin by means of brushing, painting, dipping or spraying the resin, the combined liners (60) of FIG. 6 was coated by a resin by means of either brushing or painting the resin onto the first liner (62). The resin and the curing process may be the same as those described in relation to the combined liners (10) of FIG. 1B above. The remainder of the process and other features of the shoe correspond to those described above in relation to the first example.

FIG. 7 shows a completed shoe (70) comprising an upper (72). The upper (72) may be the combined liners (10) of FIG. 1B or the combined liners (60) of FIG. 6. The upper (72) comprises an inner surface (74) for receiving a wearer's foot and an outer surface (76). The inner surface (74) is the first liner as described above in relation to FIGS. 1A and 6. The outer surface (76) may be the second liner as described above in relation to FIGS. 1A and 6. Alternatively, the outer surface (76) may be a material covering the second liner (for example a knitted, leather or textile upper). The shoe further comprises a sole (78) fitted to the bottom of the upper (72). A topline is formed around the opening of the upper (72). The topline is shown as being a stitching, although any other form of topline known in the art is also envisaged.

The example embodiment is described in terms of the waterproof garment being a shoe. It will be appreciated by the person of ordinary skill that this is exemplary and that construction of other waterproof garments is possible by the described invention.

The invention claimed is:

1. A method of constructing a waterproof garment comprising:

providing a seamless first liner, wherein the first liner is a circular knitted liner;

coating the first liner with a viscous resin;

curing the viscous resin to produce a cured resin and thereby waterproof the first liner; and covering the viscous resin with a second liner so that the first liner is nested within the second liner, whereby the second liner protects the cured resin coated on the first liner, whereby the waterproof garment is thereby constructed.

2. A method according to claim 1, wherein the first liner, and also the second liner, is seamless.

3. A method according to claim 1, wherein the first and second liners are circular knitted liners in the form of closed tubes.

4. A method according to claim 1, which is a method of making a waterproof shoe.

5. A method according to claim 4, further comprising the step of fitting the first and second liners into an upper such that the first and second liners thereby form a waterproof lining for the shoe.

6. A method according to claim 4, wherein the first and second liners together form an upper for the shoe.

7. A method according to claim 4, wherein the outermost of the first and second liners forms at least 50% of the outside upper surface of the shoe, and wherein the innermost of the first and second liners defines the foot-receiving interior of the shoe.

8. A method according to claim 4, wherein the first liner is coated with resin, which is then cured, thereby waterproofing the first liner at least where it extends around a wearer's foot in use.

9. A method according to claim 4, further comprising testing the coated first liner after the resin has cured to determine the waterproofness of the first liner.

10. A method according to claim 4, wherein the first and second liners are formed from water permeable textiles.

11. A method of constructing a waterproof shoe according to claim 4, wherein the first and second liners are shaped to enclose a wearer's foot, the method further comprising fitting a sole, and optionally an upper, to the first and second liners, to thereby form the waterproof shoe.

12. A waterproof garment constructed according to claim 1. the waterproof garment comprising a first liner and a second liner, with the first liner fitted within the second liner, the first liner being seamless and a circular knitted liner and having a waterproof layer formed on the surface of the first liner facing the second liner, wherein the waterproof layer is a cured resin layer.

13. A waterproof garment according to claim 12, wherein the first and second liners are seamless.

14. A waterproof garment according to claim 12, wherein the first and second liners are circular knitted liners in the form of closed tubes.

15. A waterproof garment according to claim 12, wherein the first and second liners are formed of a water permeable textile.

16. A waterproof garment according to claim 12, wherein the first liner is coated with the resin, and thereby rendered waterproof, across at least 90% of its surface area.

17. A waterproof shoe according to claim 12, wherein the shoe further comprises an upper, with the first and second liners therein forming a waterproof lining for the shoe.

18. A waterproof shoe according to claim 12, wherein the first and second liners together form an upper for the shoe.

19. A waterproof shoe according to claim 12, wherein the outermost of the first and second liners forms at least 50% of the outside upper surface of the shoe, and wherein the innermost of the first and second liners defines the foot-receiving interior of the shoe.

20. A waterproof shoe constructed according to claim 1, the waterproof shoe comprising a first liner and a second liner, with the first liner fitted within the second liner, the first liner comprising at least two pieces of fabric sewn together and having a waterproof layer formed on the surface of the first liner facing the second liner, wherein the waterproof layer is a cured resin layer, with the second liner being a seamless circular knitted liner.

21. The method according to claim 1, wherein the first liner and the second liner are attached to each other.

22. The method according to claim 1, wherein the second liner is joined, by stitching or welding, to a sleeve region of the first liner.

23. The method according to claim 1, wherein the first liner comprises a first liner opening, and the second liner comprises a second liner opening, and wherein when the first liner is nested within the second liner to define a garment opening, whereby a topline of the waterproof garment is formed around the garment opening.

24. The method according to claim 1, wherein a webbing or textile tape is applied at a first opening of the first liner and a second opening of the second liner, wherein the first liner and the second liner are attached to provide a finished look to the waterproof garment.

25. A method of constructing a waterproof garment comprising:

providing a seamless first liner, wherein the first liner is a circular knitted liner;

coating the first liner with a resin;

curing the resin to produce a cured resin and thereby waterproof the first liner;

covering the resin with a second liner so that the first liner is nested within the second liner, whereby the second liner protects the cured resin coated on the first liner; and testing the coated first liner after the resin has cured to determine waterproofness of the first liner, and thereby test the waterproof garment.

26. The method of claim 25, wherein the resin is viscous.

* * * * *